US005216903A

United States Patent [19]

Chen

[11] Patent Number: 5,216,903

[45] Date of Patent: Jun. 8, 1993

[54] CONCEALED SHACKLE PADLOCK

[76] Inventor: Sheng-Tai Chen, No. 187, Pao Chung St., Kaohsiung, Taiwan

[21] Appl. No.: 905,664

[22] Filed: Jun. 29, 1992

[51] Int. Cl.[5] ..... E05B 67/38

[52] U.S. Cl. ..... 70/55; 70/417

[58] Field of Search ..... 70/50, 51, 53-56, 70/417, DIG. 56

[56] References Cited

U.S. PATENT DOCUMENTS

| | | | |
|---|---|---|---|
| 1,571,057 | 1/1926 | Kroll | 70/54 |
| 2,541,638 | 2/1951 | Clevett | 70/56 |
| 2,904,985 | 9/1959 | Murphy | 70/51 |
| 3,453,846 | 7/1969 | Owen et al. | 70/54 |
| 4,226,100 | 10/1980 | Hampton et al. | 70/55 X |
| 4,888,967 | 12/1989 | Kuo | 70/54 X |

FOREIGN PATENT DOCUMENTS

| | | | |
|---|---|---|---|
| 1260582 | 2/1968 | Fed. Rep. of Germany | 70/54 |
| 2619846 | 3/1989 | France | 70/53 |

*Primary Examiner*—Lloyd A. Gall

*Attorney, Agent, or Firm*—Varndell Legal Group

[57] ABSTRACT

A concealed shackle padlock includes a shackle having a first straight protecting tube sleeved on the fixed end thereof, a second straight protecting tube removably sleeved on the free end of the shackle and connected to the casing of the padlock by a chain, and an arched protecting tube sleeved on the arched middle part of the shackle. By way of the protection of the first and second straight protecting tube, and the arched protecting tube, it is nearly impossible to open the padlock with bolt cutters, hacksaws or jimmying tools.

7 Claims, 4 Drawing Sheets

CONCEALED SHACKLE PADLOCK

BACKGROUND OF THE INVENTION

The present invention relates to padlocks and relates more particularly to a concealed shackle padlock having shackle protecting tubes for protecting the shackle against bolt cutters, hacksaws and jimmying tools.

Various padlocks are known and widely used for the advantage of removable. A conventional padlock, as illustrated in FIG. 1, has a shackle that can be passed through a staple or link and then secured. Because the shackle is exposed to the outside, a conventional padlock may be opened by an intruder with a bolt cutter, hacksaw or jimmying tool. In order to provide added protection, there is disclosed a padlock with shackle protecting plates. This structure of a padlock, as illustrated in FIGS. 2 and 3, has two shackle protecting plates on the top of the casing at two opposite ends thereof. One shackle protecting plate has a substantially U-shaped cross section surrounding the fixed end of the shackle. The other shackle protecting plate has a substantially L-shaped cross section for protecting the free end of the shackle. This structure of a padlock is complicated and expensive to manufacture. When opening or closing this padlock, the arched middle part of the shackle must be lifted over the top edge of the U-shaped shackle protecting plate so that the free end of the shackle can be rotated outwards or inwards relative to the casing of the padlock. Another disadvantage of this structure of a padlock is that the L-shaped shackle protecting plate which is provided for protecting the fee end of the shackle can not protect against jimmying tools. The arrangement of this L-shaped shackle protecting plate limits the rotary range of the shackle within a fixed angle (see FIG. 3), i.e., the free end of the shackle is prohibited from rotating through a 360 angle. Furthermore, the arched middle part of the shackle may be exposed to the outside when locked on chains (see FIG. 4), and the padlock may be opened with a bolt cutter or hacksaw.

SUMMARY OF THE INVENTION

The present invention eliminates the aforesaid disadvantages and problems. One object of the present invention is to provide a concealed shackle padlock which effectively protects the shackle against bolt cutters, hacksaws, and jimmying tools. Another object of the present invention is to provide a concealed shackle padlock which is inexpensive to manufacture and easy to use.

According to one aspect of the present invention, a concealed shackle padlock is generally comprised of a first straight protecting tube sleeved on the fixed end of the shackle, a second straight protecting tube removably sleeved on the free end of the shackle, and an arched protecting tube sleeved on the arched middle part of the shackle. According to another aspect of the present invention, the height difference between either end of the outside curved surface and the highest point on the inside curved surface of the arched protecting tube is longer than the outer diameter of said shackle, so that the arched protecting sleeve can be sleeved onto the arched middle part of the shackle. According to still another aspect of the present invention, the second straight protecting tube is connected to the casing by a chain.

DETAILED DESCRIPTION OF THE PREFERRED EMBODIMENT

Figure 2:
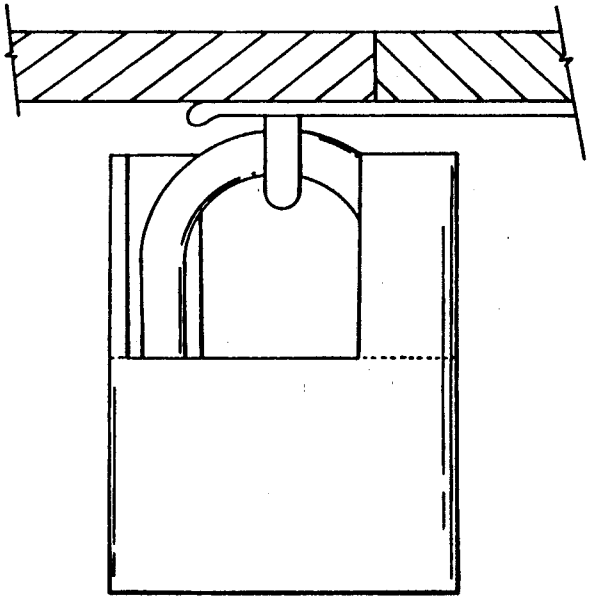
FIG. 2 PRIOR ART
FIG. 2 illustrates another prior art padlock which has protecting plates for protecting the shackle.
Figure 1:
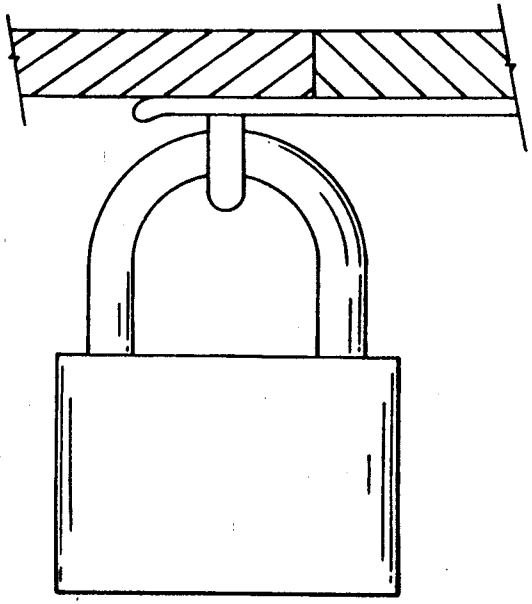
FIG. 1 PRIOR ART
FIG. 1 illustrates a prior art padlock when locked on a stable.
Figure 4:
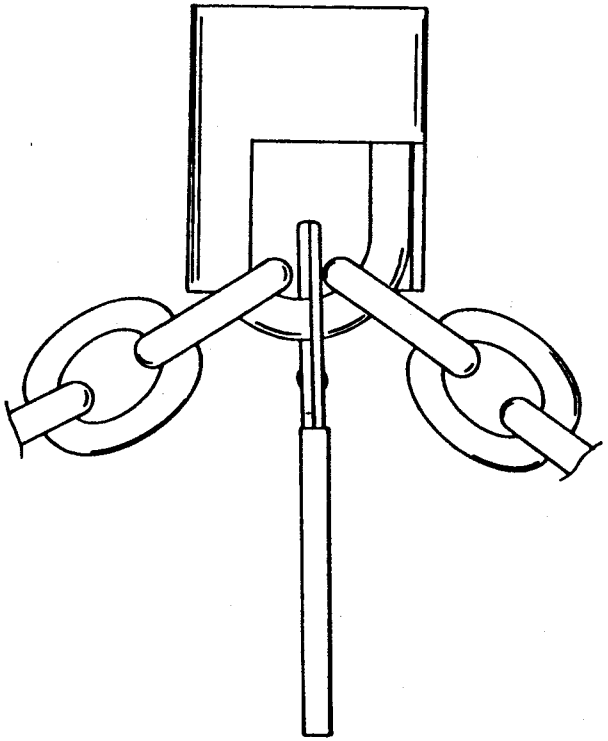
FIG. 4 PRIOR ART
FIG. 4 illustrates that the arched middle part of the shackle of the padlock of FIG. 2 is exposed to the outside when locked on chains.
Figure 3:
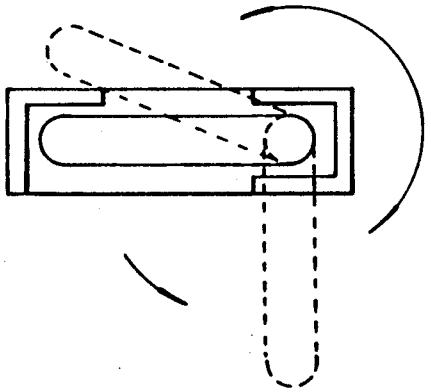
FIG. 3 PRIOR ART
FIG. 3 illustrates the limited range of the rotary movement of the free end of the shackle of the padlock of FIG. 2.
Figure 5:
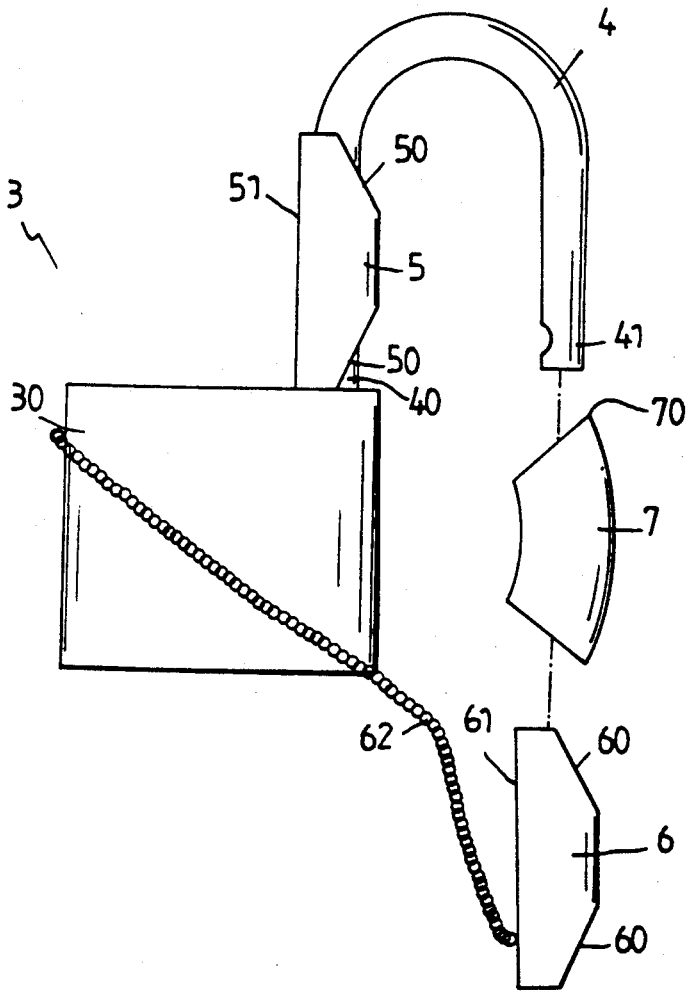
FIG. 5 is a plain view showing a concealed shackle padlock embodying the present invention.
Figure 7:
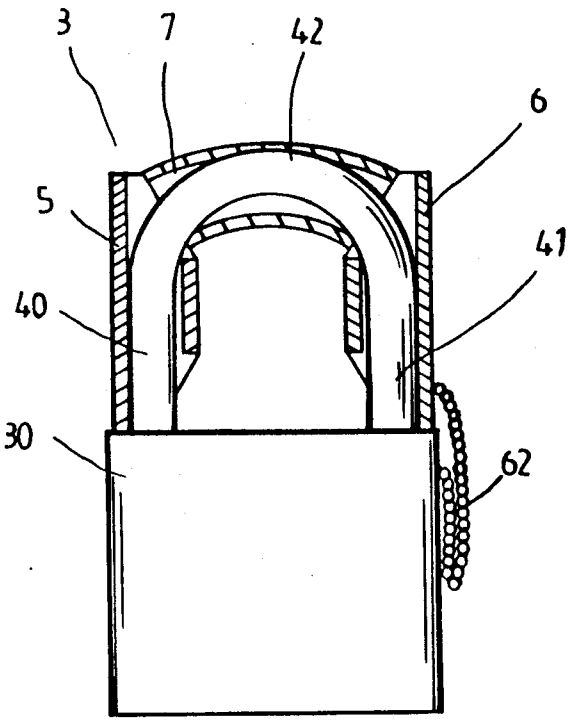
FIG. 7 is a sectional assembly view of the concealed shackle padlock showing the shackle in its secured, by locked position and protected by the protecting tubes.
Figure 6:
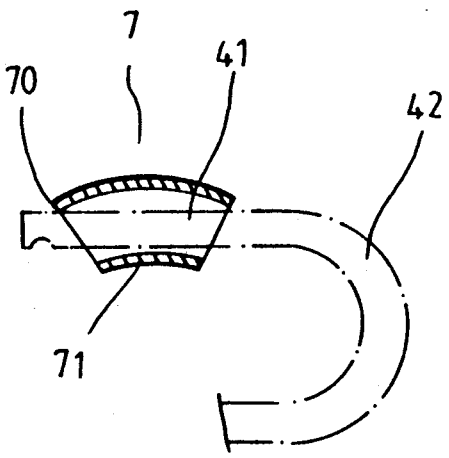
FIG. 6 is a sectional view of the third protecting tube showing that the shackle can be inserted through the arched boring bore of the third protecting tube.

Referring to FIGS. 5, 6 and 7, a concealed shackle padlock 3 as constructed in accordance with the present invention is generally comprised of a casing 30 having a shackle 4 that can be passed through a staple or link and then secured, and three protecting tubes, namely, a first protecting tube 5, a second protecting tube 6 and a third protecting tube 7 respectively sleeved on the shackle 4. The first protecting tube 5 is sleeved on the fixed end 40 of the shackle 4; the second protecting tube 6 is sleeved on the free end 41 of the shackle 4; the third protecting tube 7 is sleeved on the curved middle part 42 of the shackle 4 and stopped between the first and second protecting tubes 5,6. The first and second protecting tubes 5,6 are each made from a straight tube (either round or square straight tube) respectively having two beveled edges 50 or 60 on two opposite ends on the same side, so that the third protecting tube 7 can be tightly stopped between and abut the first and second protecting tubes 5,6. The first protecting tube 5 is sleeved on the fixed end 40 of the shackle 4 before the fastening of the fixed end 40 of the shackle 4 to the casing 30. When fastened, the two opposite beveled edges 50 on the first protecting tube 5 are disposed on an inner side relative to the shackle 4, and the first protecting tube 5 rotates with the fixed end 40 of the shackle 4 when it rotates on the casing 30. The second protecting tube 6 is connected to the casing 30 by a chain 62, and therefore it is not lost when the shackle 4 is unlocked. The third protecting tube 7 is made in the shape of an arch in which the difference in height between the lowest point of either end 70 of the exterior curve and the highest point 71 of the interior curve is greater than the thickness of the shackle 4, is that the third protecting tube 7 can be sleeved onto the curved middle part 42 of the shackle. The edges of ends 70 of the third protecting tube 7 are beveled to respectively match the beveled edges 50 and 60 of the first and second protecting tubes, so that when the shackle is in its locked position the edges of the first, second and third protecting tubes abut each other without any space therebetween as shown in FIG. 7.

By means of the protection of the protecting tubes 5,6,7, it is nearly impossible to open the padlock with bolt cutters, hacksaws or jimmying tools.

I claim:

1. A concealed shackle padlock comprising a casing, a shackle and a shackle protector, said shackle having a free end releasably locked in said casing and capable of passing through a staple or link, a fixed end rotatably fixed to said casing and an arched middle part between said free and fixed ends, said shackle protector covering said shackle for protection against bolt cutters and comprising a first straight protecting tube sleeved on said fixed end of said shackle, a second straight protecting tube sleeved on said free end of said shackle and an arched protecting tube sleeved on said arched middle part of said shackle and stopped between said first and second protecting tubes, said first and second straight protecting tubes each being a straight tube having two beveled edges on two opposite ends on a same side thereof.

2. The concealed shackle padlock according to claim 1, wherein said arched protecting tube comprises a bore defined between an outside curved surface and an inside curved surface through which said shackle is inserted, and a difference in height between a lowest point of either end of said outside curved surface and a highest point on said inside curved surface is greater than a thickness of said shackle.

3. The concealed shackle padlock according to claim 1, wherein said arched protecting tube has beveled edges on opposite ends thereof respectively matching said beveled edges of said first and second straight protecting tubes.

4. A concealed shackle padlock comprising a casing, a shackle and a shackle protector, said shackle having a free end releasably locked in said casing and capable of passing through a staple or link, a fixed end rotatably fixed to said casing and an arched middle part between said free and fixed ends, said shackle protector covering said shackle for protection against bolt cutters and comprising a first straight protecting tube sleeved on said fixed end of said shackle, a second straight protecting tube sleeved on said free end of said shackle and connected to said casing by a chain, and an arched protecting tube sleeved on said arched middle part of said shackle and stopped between said first and second protecting tubes.

5. A concealed shackle padlock comprising a casing, a shackle and a shackle protector, said shackle having a free end releasably locked in said casing and capable of passing through a staple or link, a fixed end rotatably fixed to said casing and an arched middle part between said free and fixed ends, said shackle protector covering said shackle for protection against bolt cutters and comprising a first straight protecting tube sleeved on said fixed end of said shackle, a second straight protecting tube sleeved on said free end of said shackle and an arched protecting tube sleeved on said arched middle part of said shackle and stopped between said first and second protecting tubes, said first and second straight protecting tubes each being a straight tube respectively having a beveled edge on an end thereof adjacent said arched protecting tube.

6. The concealed shackle padlock according to claim 5, wherein said arched protecting tube has beveled edges on opposite ends thereof respectively matching said beveled edges of said first and second straight protecting tubes.

7. The concealed shackle padlock according to claim 5, wherein said arched protecting tube comprises a bore defined between an outside curved surface and an inside curved surface through which said shackle is inserted, and a difference in height between either end of said outside curved surface and a highest point on said inside curved surface is greater than a thickness of said shackle.

* * * * *